US010704513B2

(12) United States Patent
Morimoto

(10) Patent No.: US 10,704,513 B2
(45) Date of Patent: Jul. 7, 2020

(54) INTAKE MANIFOLD

(71) Applicant: HONDA MOTOR CO., LTD., Minato-ku, Tokyo (JP)

(72) Inventor: Tatsuya Morimoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/217,386

(22) Filed: Dec. 12, 2018

(65) Prior Publication Data

US 2019/0178209 A1 Jun. 13, 2019

(30) Foreign Application Priority Data

Dec. 13, 2017 (JP) ..... 2017-238423

(51) Int. Cl.
*F02M 35/104* (2006.01)
*F02M 35/12* (2006.01)
*F02M 35/08* (2006.01)

(52) U.S. Cl.
CPC ..... *F02M 35/104* (2013.01); *F02M 35/088* (2013.01); *F02M 35/1255* (2013.01)

(58) Field of Classification Search
CPC . F02M 35/104; F02M 35/088; F02M 35/1255
See application file for complete search history.

(56) References Cited

U.S. PATENT DOCUMENTS 9,995,205 B2 * 6/2018 Park ..... F02B 29/0468
2006/0005801 A1 * 1/2006 Nishizawa ..... F02M 35/022 123/198 E
2008/0072863 A1 * 3/2008 Egawa ..... F02M 35/10288 123/184.57
2008/0135010 A1 * 6/2008 Prior ..... F02M 35/10032 123/184.57
2009/0199808 A1 * 8/2009 Otsubo ..... F02M 35/10301 123/184.57
2011/0232598 A1 * 9/2011 Harada ..... F02M 29/00 123/184.47
2014/0165948 A1 * 6/2014 Sekiguchi ..... F02M 35/10 123/184.21
2019/0136805 A1 * 5/2019 Tanaka ..... F02M 35/10039

FOREIGN PATENT DOCUMENTS

JP 2013-249823 A 12/2013

* cited by examiner

*Primary Examiner* — Joseph J Dallo
*Assistant Examiner* — Kurt Philip Liethen
(74) *Attorney, Agent, or Firm* — Carrier Blackman & Associates, P.C.; Joseph P. Carrier; Jeffrey T. Gedeon

(57) ABSTRACT

In an intake manifold, a downstream end of an intake introduction pipe has an intake chamber connected thereto, and a resonator is provided adjacent to a bent section of the intake introduction pipe. A resonance chamber of this resonator communicates with the intake chamber via a path-for-resonance. A bottom section of the resonance chamber representing a downward side in a gravity direction inclines downwardly toward a center in a width direction, and a communicating path is formed to communicate with the bent section of the intake introduction pipe. Condensed water accumulated in the resonator flows to the intake introduction pipe through the communicating path from the bottom section, and flows into a projection projecting downwardly from the bent section. Subsequently, the condensed water is discharged to an internal combustion engine side through a gas introduction pipe by which a blow-by gas is introduced.

5 Claims, 3 Drawing Sheets

INTAKE MANIFOLD

CROSS-REFERENCE TO RELATED APPLICATION

This application is based upon and claims the benefit of priority from Japanese Patent Application No. 2017-238423 filed on Dec. 13, 2017, the contents of which are incorporated herein by reference.

BACKGROUND OF THE INVENTION

Field of the Invention

The present invention relates to an intake manifold for supplying intake air to a plurality of cylinder chambers of an internal combustion engine.

Description of the Related Art

The applicant of this application has proposed a structure by which an inflow into a multi-cylinder internal combustion engine, of condensed water that has accumulated on an inside of an intake manifold connected to the internal combustion engine, can be prevented by the intake manifold (refer to Japanese Laid-Open Patent Publication No. 2013-249823). In this intake manifold, a chamber is provided in an intake chamber, and an inside of a resonator adjacent to the chamber is provided with a resonance chamber. Moreover, the chamber and the resonance chamber are in communication via a resonance communicating path that has been opened in a bottom surface of the intake chamber.

An opening of this resonance communicating path is positioned in the bottom surface of the intake chamber, with a lower edge of an opening in an intake introduction pipe being positioned slightly more upwardly than the opening of the resonance communicating path, and a lower edge of an opening in each of branch pipes being positioned more upwardly than a lower edge of the opening of the resonance communicating path. As a result, condensed water that has been generated within the intake chamber flows to the resonator through the resonance communicating path and never flows into each of the branch pipes.

SUMMARY OF THE INVENTION

A general object of the present invention is to provide an intake manifold capable of reliably preventing a lowering of performance due to condensed water accumulating on an inside of the intake manifold.

The present invention is an intake manifold including: a chamber section that extends along a cylinder column direction of a multi-cylinder internal combustion engine; an intake introduction section that extends from one end side along the cylinder column direction and bends toward a chamber section side, and whose downstream end is connected to substantially a central section along the cylinder column direction of the chamber section and whose upstream end is connected to an intake valve; and a plurality of branch pipes that, with respect to a connection region of the intake introduction section and the chamber section, have their upstream end connected to the chamber section on a one side and an other side along the cylinder column direction and have their downstream end connected to the internal combustion engine, a space on the other side partitioned by the intake introduction section, the chamber section, and the branch pipes being provided with a resonance chamber section that communicates via an opening with the chamber section, and a blow-by gas from the internal combustion engine being supplied to inside the intake introduction section through a gas introduction pipe communicating with the intake introduction section, the intake manifold including a communicating path that, in a state where the intake manifold has been attached to the internal combustion engine, opens in a downward portion in a gravity direction in the resonance chamber section and communicates with a bent section of the intake introduction section bent to the chamber section side.

Due to the present invention, sometimes when, in a state where an intake manifold has been attached to an internal combustion engine, a blow-by gas is supplied to an intake introduction section through a gas introduction pipe from the internal combustion engine, moisture contained therein is cooled, becomes condensed water, and flows into a resonance chamber section.

Even in such a case, by there being included the communicating path that opens in a downward portion in the gravity direction in the resonance chamber section and communicates with the bent section of the intake introduction section bent to the chamber section side, the condensed water moves to the downward side in the resonance chamber section under gravitational action, is discharged to the bent section side of the intake introduction section through the opened communicating path, and is then discharged to the internal combustion engine side through the gas introduction pipe.

As a result, by the condensed water being reliably discharged from the resonance chamber section, a volume change due to the condensed water accumulating internally can be prevented, and a change in performance of the intake manifold due to this volume change can be reliably prevented.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

This intake manifold 10 is provided to, for example, a multi-cylinder internal combustion engine 14 (refer to FIG. 3) mounted in a vehicle, or the like, and having a plurality of cylinder chambers. Note that an intake manifold 10 employed for a four-cylinder internal combustion engine 14 will be described here, and that description is made assuming a cylinder column direction in which the cylinders are aligned, to be a width direction (a direction of arrows A, B in FIGS. 1 and 2).

Figure 1:
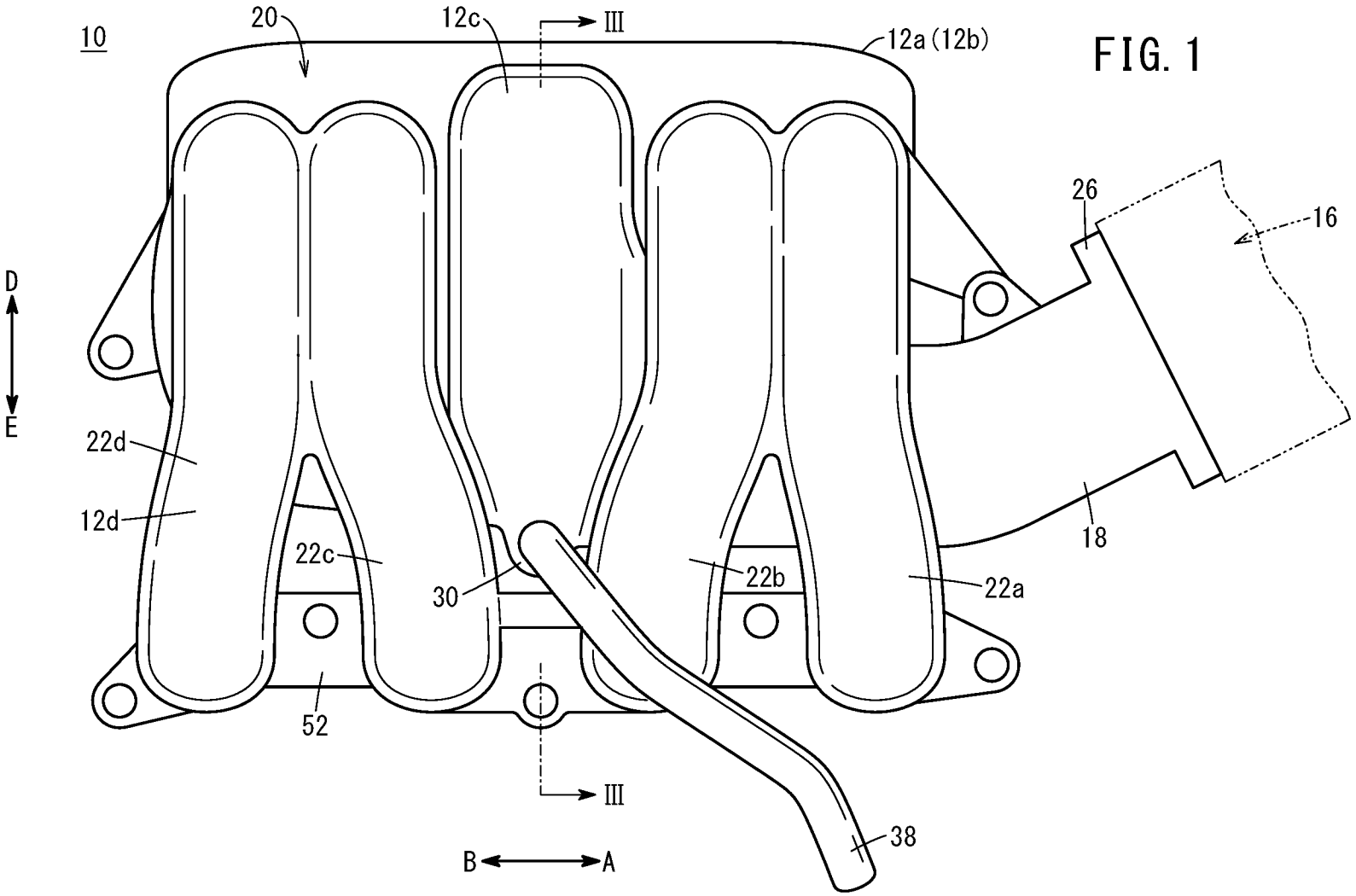
FIG. 1 is an overall front view of an intake manifold according to an embodiment of the present invention.
Figure 2:
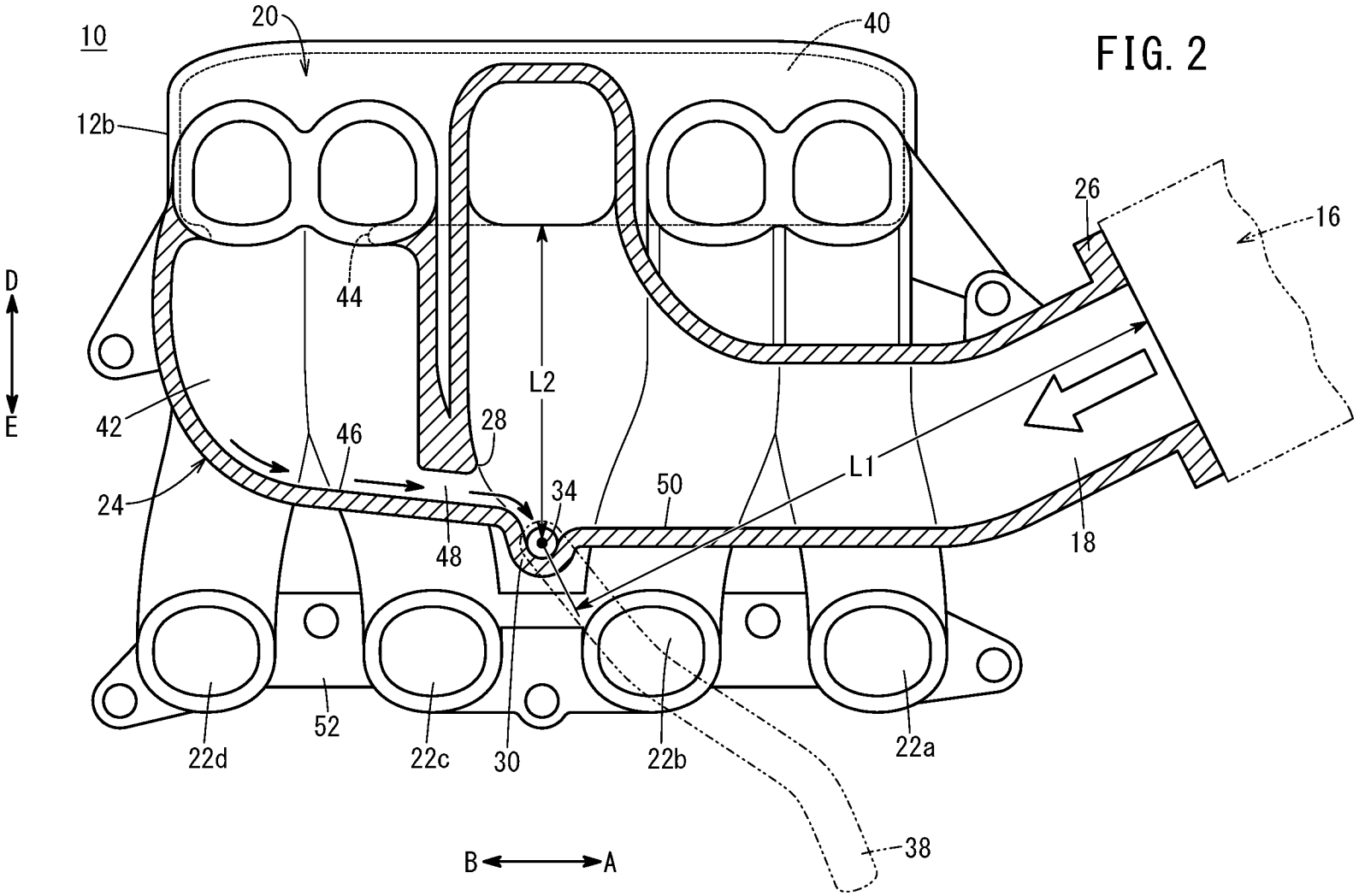
FIG. 2 is an overall cross-sectional view of the intake manifold shown in FIG. 1.
Figure 3:
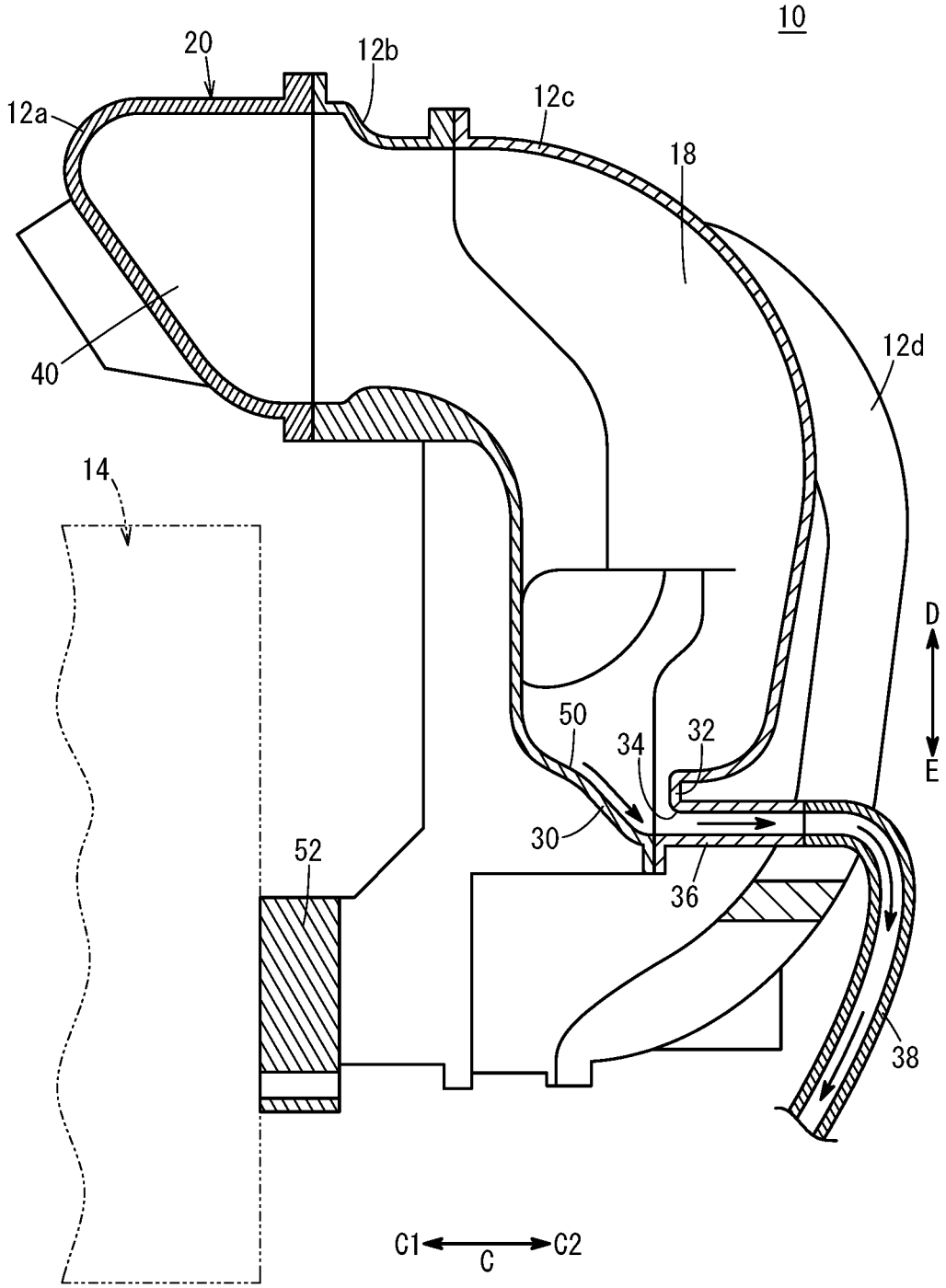
FIG. 3 is a cross-sectional view taken along the line III-III of FIG. 1.

As shown in FIGS. 1-3, the intake manifold 10 adopts as configuring elements first through fourth partitioned bodies 12*a*-12*d* configured from a resin-made material, for example, and these first through fourth partitioned bodies

12*a*-12*d* are joined by being welded to each other along a depth direction (a direction of arrow C in FIG. 3) orthogonal to the width direction (the direction of arrows A, B) of the intake manifold 10. Note that the first partitioned body 12*a* is disposed most to an internal combustion engine 14 side (most in a direction of arrow C1), and that the second partitioned body 12*b*, third partitioned body 12*c*, and fourth partitioned body 12*d* are disposed in that order in a direction of sequentially separating from the internal combustion engine 14.

This intake manifold 10 includes: an intake introduction pipe (an intake introduction section) 18 that opens at a one end section thereof along the width direction (the direction of arrows A, B) and is supplied with intake air from a throttle valve 16; an intake chamber (a chamber section) 20 into which the intake air from the intake introduction pipe 18 is introduced; first through fourth branch pipes 22*a*-22*d* by which the intake air within the intake chamber 20 is distributed to each of ports of the internal combustion engine 14; and a resonator (a resonance chamber section) 24 that communicates with the intake chamber 20 (refer to FIG. 2).

The intake introduction pipe 18 is configured from the second partitioned body 12*b* and the third partitioned body 12*c*, and is formed in substantially an L shape where after extending along the width direction from the one end section to a central section of the intake manifold 10, it extends upwardly (in a direction of arrow D) in a substantially orthogonal manner.

The one end section representing an upstream side of this intake introduction pipe 18 has formed therein a flange 26 substantially orthogonal to the width direction, and has coupled thereto the throttle valve (an intake valve) 16 for adjusting a supplied amount of intake air to the intake manifold 10. Moreover, an other end section representing a downstream side of the intake introduction pipe 18 extends upwardly (in the direction of arrow D) and is connected to and in communication with a central section in the width direction of the intake chamber 20.

On the other hand, as shown in FIGS. 2 and 3, a substantially central section of the intake introduction pipe 18 includes a bent section 28 where a side of the one end section extending horizontally along the width direction (the direction of arrows A, B) and a side of the other end section extending in a vertical direction are joined, and this bent section 28 is formed having an arc-shaped cross section configured from a certain radius.

This bent section 28 has formed therein a projection 30 that projects further downwardly (in a direction of arrow E) from a bottom surface 50 representing a lower side in a gravity direction of the bent section 28. This projection 30 is formed in a bag shape of U-shaped cross section having a bottom section on its lower side, and in a side wall 32 (refer to FIG. 3) substantially orthogonal to the bottom section, there opens a gas introduction port 34 to which a blow-by gas is supplied from the internal combustion engine 14. Note that the projection 30 is formed in the second partitioned body 12*b* configuring the intake manifold 10. Moreover, the above-mentioned gravity direction (the direction of arrows D, E) is substantially the same direction as an up-down direction of the vehicle where the internal combustion engine 14 is mounted.

As shown in FIG. 3, this gas introduction port 34 opened in the projection 30 has connected thereto a pipe-like gas introduction pipe 36 having a path on its inside, and the gas introduction pipe 36 extends linearly in a direction of separating from the internal combustion engine 14 (a direction of arrow C2) along the depth direction (the direction of arrow C) orthogonal to the width direction of the intake manifold 10. This gas introduction pipe 36 is formed in the third partitioned body 12*c* so as to face the projection 30 of the second partitioned body 12*b*.

In addition, as shown in FIGS. 1 and 3, a tube 38 is connected to the gas introduction pipe 36 at an end section thereof representing a third partitioned body 12*c* side (the direction of arrow C2). This tube 38 extends by an amount of a certain length in the depth direction from the end of the gas introduction pipe 36, and then extends bending downwardly in the gravity direction (in the direction of arrow E), and is connected to a crankcase (not illustrated) of the internal combustion engine 14.

Moreover, blow-by gas that has leaked out to the crankcase from the cylinder chambers of the internal combustion engine 14 is extracted through the tube 38, and supplied to an inside of the intake introduction pipe 18 through the gas introduction pipe 36 and the gas introduction port 34.

Furthermore, as shown in FIG. 2, a straight-line distance L1 from the gas introduction port 34 opened in the projection 30 to the throttle valve 16 is set so as to be longer than a straight-line distance L2 from the gas introduction port 34 to a connection region of the other end section of the intake introduction pipe 18 and the intake chamber 20 (L1>L2).

The intake chamber 20 is configured from the first partitioned body 12*a* and part of the second partitioned body 12*b*, and is formed in a box shape formed in an upper section in the intake manifold 10 and extending along the width direction (the direction of arrows A, B). Moreover, the inside of the intake chamber 20 is provided with a chamber 40 having a space of a certain volume, and the other end section of the intake introduction pipe 18 is connected to a center in the width direction of the intake chamber 20.

As shown in FIG. 2, the resonator 24 resonates in a specific frequency range occurring under drive action of the internal combustion engine 14, and is provided with the purpose of an improvement in output (for example, an increase in torque) of the internal combustion engine 14. This resonator 24 is provided on a side of the other end section (in the direction of arrow B) along the width direction, and is provided so as to include on its inside a resonance chamber 42 and be adjacent in the width direction to the bent section 28 of the intake introduction pipe 18.

The resonance chamber 42 communicates with the intake chamber 20 via an upwardly extending path-for-resonance (an opening) 44 (refer to FIG. 2), and its bottom section 46 is formed having a curved cross section gradually extending downwardly in the gravity direction (in the direction of arrow E) from a side of the other end section in the width direction toward a side of the central section (in the direction of arrow A). Moreover, a communicating path 48 is connected to and opens at a position that is lowest in the gravity direction (the direction of arrow E) on a center side in the width direction (the direction of arrow A), in the resonance chamber 42.

The communicating path 48 extends so as to incline downwardly (in the direction of arrow E) from the bottom section 46 of the resonance chamber 42 toward the center side in the width direction, and its end section is connected to and in communication with the bent section 28 in the intake introduction pipe 18. In other words, the communicating path 48 communicates the bottom section 46 of the resonance chamber 42 in the resonator 24 and the bottom surface 50 of the intake introduction pipe 18, and is connected to a position facing the projection 30.

As shown in FIG. 3, the first through fourth branch pipes 22*a*-22*d* have their upstream end section connected to a front surface of the intake chamber 20 on an opposite side to the internal combustion engine 14 (the direction of arrow C2). Moreover, the first through fourth branch pipes 22*a*-22*d* are bent in substantially an arc shape in a direction of separating from the internal combustion engine 14 (in the direction of arrow C2), after which their downstream end section is fastened to a cylinder head of the internal combustion engine 14 via a fastening flange 52.

As shown in FIG. 2, the first and second branch pipes 22*a*, 22*b* are formed so as to be wrapped around an outer peripheral side of the intake introduction pipe 18, whereas the third and fourth branch pipes 22*c*, 22*d* configure the resonator 24 being a space enclosed by the intake introduction pipe 18 and the intake chamber 20.

Moreover, the first through fourth branch pipes 22*a*-22*d* are configured by the second through fourth partitioned bodies 12*b*-12*d*, and have their upstream side end sections and downstream side end sections each formed in the second partitioned body 12*b*.

The intake manifold 10 according to the embodiment of the present invention is basically configured as above, and will next have its operation and functional advantages described.

First, accompanying an intake action of each of the cylinder chambers in the internal combustion engine 14, intake air is supplied to the intake introduction pipe 18 at a flow rate adjusted by the throttle valve 16, and passes through the bent section 28 from the one end section of the intake introduction pipe 18, whereby the intake air circulates from the downstream side end section to the intake chamber 20.

In the chamber 40 of this intake chamber 20, the intake air is distributed to each of the first through fourth branch pipes 22*a*-22*d*, and the intake airs that have respectively flowed to the downstream end section along these first through fourth branch pipes 22*a*-22*d*, are sequentially supplied to inside each of the cylinders through the cylinder head of the internal combustion engine 14.

Moreover, part of the intake air introduced into the chamber 40 of the intake chamber 20 flows into the resonance chamber 42 of the resonator 24 via the path-for-resonance 44, to be stored. Then, when the resonator 24 resonates in the specific frequency range due to a pressure vibration occurring under drive action of the internal combustion engine 14, the intake air within the resonator 24 is supplied to the intake chamber 20 through the path-for-resonance 44. By so doing, it results in the intake air supplied to inside the intake chamber 20 being distributed to the first through fourth branch pipes 22*a*-22*d* and supplied to the internal combustion engine 14.

On the other hand, blow-by gas that has leaked out to the crankcase from the cylinder chambers of the internal combustion engine 14 is supplied to the intake introduction pipe 18 through the gas introduction pipe 36 and the gas introduction port 34 from the tube 38, and, along with the intake air flowing through this intake introduction pipe 18, is supplied to inside of the internal combustion engine 14 to be combusted again in the cylinder chambers.

The above-mentioned blow-by gas includes moisture, and so on, as combustion products, and this moisture, after having been deposited on an inner wall of the intake chamber 20 in the intake manifold 10, becomes condensed water by being cooled, resulting in it accumulating in the intake chamber 20 and the bottom section 46 of the resonator 24. The condensed water that has accumulated in the intake chamber 20 gradually evaporates due to the in-flowing intake air and becomes steam, thereby flowing into the internal combustion engine 14 from the first through fourth branch pipes 22*a*-22*d*.

On the other hand, the condensed water that has accumulated in the resonance chamber 42 of the resonator 24 flows to the center side in the width direction along the bottom section 46 inclined downwardly in the gravity direction (in the direction of arrow E), after which it flows to a bent section 28 side of the intake introduction pipe 18 through the communicating path 48 to be guided to inside the downwardly-recessed projection 30.

Then, in the case that the blow-by gas is being supplied to inside the intake manifold 10 through the gas introduction port 34, the condensed water that has accumulated in the projection 30 moves into the intake introduction pipe 18 due to a flow of the blow-by gas. Subsequently, the condensed water is agitated by the intake air and thereby introduced into the internal combustion engine 14 through the first through fourth branch pipes 22*a*-22*d* from the intake chamber 20 and combusted again in each of the cylinder chambers (not illustrated).

Moreover, in the case that recirculation to the intake manifold 10 of blow-by gas through the gas introduction port 34 has stopped, the condensed water inside the projection 30 is discharged to inside the crankcase of the internal combustion engine 14 through the gas introduction port 34, the gas introduction pipe 36, and the tube 38. That is, the condensed water is discharged to the internal combustion engine 14 side from the intake manifold 10 by being circulated in an opposite direction to during recirculation of the blow-by gas.

As a result, it is avoided that the condensed water ends up accumulating in the resonance chamber 42 of the resonator 24 in the intake manifold 10 and that the volume ends up changing due to this condensed water, and there is reliably prevented a lowering of performance of the intake manifold 10 due to the volume change.

As indicated above, in the present embodiment, the intake introduction pipe 18 configuring the intake manifold 10 includes the bent section 28 bent upwardly toward the intake chamber 20 side in substantially the central section along the width direction, there is provided the projection 30 that projects downwardly in the gravity direction (in the direction of arrow E) from the bottom surface 50 of this bent section 28, and on the inside of the projection 30, there is formed the gas introduction port 34 by which the blow-by gas is supplied. Moreover, the resonance chamber 42 of the resonator 24 adjacent to the bent section 28 of the intake introduction pipe 18 has its bottom section 46 inclining so as to be more downward in the gravity direction (more in the direction of arrow E) as the center in the width direction of the resonance chamber 42 is approached, and the communicating path 48 opens in a region representing the lower end of the bottom section 46 to be in communication with the bottom surface 50 of the bent section 28.

As a result, even when moisture included in the blow-by gas has cooled to become condensed water and has flowed into the resonance chamber 42 of the resonator 24, the condensed water moves, under gravitational action, to the bottom section 46 representing a downward side, and by moving along this bottom section 46, is guided to the communicating path 48 and discharged to the intake introduction pipe 18 side in a preferable manner. Moreover, by the condensed water being guided inside the projection 30 projecting downwardly in the bent section 28 of the intake introduction pipe 18, the condensed water can be reliably discharged to the internal combustion engine 14 side from the intake manifold 10 through the gas introduction port 34 opened in the projection 30, and through the gas introduction pipe 36 and tube 38.

As a result, volume change of the resonator 24 due to condensed water accumulating in the resonance chamber 42 can be prevented, and a change in performance of the intake manifold 10 caused by this volume change can be reliably prevented.

Moreover, since there is provided the projection 30 that projects downwardly with respect to the bent section 28 of the intake introduction pipe 18, then even when moisture included in the blow-by gas introduced to the inside of the intake manifold 10 has become condensed water, has been deposited on an inner wall surface of the intake introduction pipe 18, and has moved downwardly under gravitational action, it moves to inside the projection 30 projecting downwardly in the gravity direction (in the direction of arrow E) with respect to the bent section 28, and thereby accumulates in the projection 30.

Therefore, it is prevented that the condensed water continues to accumulate in the bottom surface 50 of the intake introduction pipe 18, and it is suppressed that, due to effects of reverse flow where intake air that has been introduced into the intake introduction pipe 18 flows back to the one end side (in the direction of arrow A), the condensed water ends up moving to the throttle valve 16 side to be deposited.

Furthermore, because the projection 30 is formed in the bent section 28 in the intake introduction pipe 18, it becomes possible that, even when, for example, the blow-by gas is supplied to the intake manifold 10 side from the internal combustion engine 14, and discharge to the internal combustion engine 14 side of condensed water through the gas introduction pipe 36 and the tube 38 cannot be performed, the condensed water that has accumulated in the projection 30 is agitated upwardly and evaporated by the intake air flowing along the bent section 28. Therefore, the evaporated condensed water can be supplied to the internal combustion engine 14 from the intake manifold 10 to be combusted, along with the intake air.

Further still, the gas introduction pipe 36 by which the blow-by gas is introduced, is connected to and in communication with the projection 30 that projects downwardly in the gravity direction (in the direction of arrow E) with respect to the intake introduction pipe 18. Therefore, it becomes possible for the gas introduction pipe 36 to have a sufficient distance secured with respect to the intake chamber 20, and, along with that, by the condensed water that has accumulated in the projection 30 and the blow-by gas supplied from the projection 30 being agitated in a preferable manner by the flow of intake air in an interval to the intake chamber 20, the condensed water and blow-by gas can be caused to flow uniformly to the plurality of first through fourth branch pipes 22*a*-22*d* from the intake chamber 20.

As a result, deposition of combustion products, such as oil, on an intake valve that is provided on a downstream side of the first through fourth branch pipes 22*a*-22*d* and introduces the intake air into the cylinder chambers, is prevented, and it becomes possible to prevent build-up of a deposit or combustion failure caused by this deposition.

Still further, by the gas introduction pipe 36 being disposed at a lower end in the gravity direction of the intake introduction pipe 18 in the intake manifold 10, the condensed water that has accumulated in the bottom surface 50 of the intake introduction pipe 18 can be reliably returned to a crankcase side of the internal combustion engine 14 through the gas introduction pipe 36 and the tube 38. Therefore, accumulation of condensed water on the inside of the intake manifold 10 is suppressed, and it becomes possible for deposition of condensed water on the throttle valve 16 to be reduced in a more preferable manner, even when reverse flow of the intake air has occurred in the intake introduction pipe 18.

Moreover, the bottom section 46 of the resonance chamber 42 in the resonator 24 is formed inclined such that its central section side (in the direction of arrow A) will be more to a downward side in the gravity direction (more in the direction of arrow E) than its other end section side (in the direction of arrow B) along the width direction, and has the communicating path 48 opened on this downward side central section side. Therefore, since the condensed water deposited in the resonance chamber 42 can be discharged to the projection 30 of the intake introduction pipe 18 by being moved along the bottom section 46 and efficiently guided into the communicating path 48, and since the gas introduction pipe 36 is connected via the gas introduction port 34 to the projection 30, then the condensed water can be reliably discharged to the internal combustion engine 14 side without being accumulated in the bottom surface 50 of the intake introduction pipe 18.

Furthermore, the straight-line distance L1 from the projection 30 provided in the intake introduction pipe 18 to the throttle valve 16 is set longer than the straight-line distance L2 from a downstream end representing the connecting region of the intake introduction pipe 18 and the intake chamber 20 to the projection 30. This makes it possible to sufficiently secure a distance from the throttle valve 16, while achieving a distance that the gas introduction port 34 (the gas introduction pipe 36) provided in the projection 30 can be sufficiently separated from the intake chamber 20 and the condensed water dispersed. As a result, it can be prevented that condensed water is deposited in the throttle valve 16 due to reverse flow, and it is possible to reliably prevent operational failure, and so on, of the throttle valve 16 caused by this deposition.

Note that the intake manifold according to the present invention is not limited to the above-mentioned embodiment, and that a variety of configurations may of course be adopted without departing from the essence and gist of the present invention.

What is claimed is:

1. An intake manifold including: a chamber section that extends along a cylinder column direction of a multi-cylinder internal combustion engine; an intake introduction section that extends from one end side along the cylinder column direction and bends toward a chamber section side, and whose downstream end is connected to substantially a central section along the cylinder column direction of the chamber section and whose upstream end is connected to an intake valve; and a plurality of branch pipes that, with respect to a connection region of the intake introduction section and the chamber section, have their upstream end connected to the chamber section on a first side and a second side along the cylinder column direction and have their downstream end connected to the internal combustion engine, a space on the second side partitioned by the intake introduction section, the chamber section, and the branch pipes being provided with a resonance chamber section that communicates via an opening with the chamber section, and a blow-by gas from the internal combustion engine being supplied to inside the intake introduction section through a gas introduction pipe communicating with the intake introduction section, the intake manifold comprising a communicating path that, in a state where the intake manifold has been attached to the internal combustion engine, opens in a downward portion with respect to an up-down direction of a vehicle in which the internal combustion engine is mounted, in the resonance chamber section and communicates with a bent section of the intake introduction section bent to the chamber section side.

2. The intake manifold according to claim 1, wherein the bent section has formed therein a hollow projection that projects downwardly with respect to the up-down direction of the vehicle in which the internal combustion engine is mounted.

3. The intake manifold according to claim 2, wherein the gas introduction pipe is connected to and communicates with the projection.

4. The intake manifold according to claim 1, wherein in the resonance chamber section, a bottom wall representing a downward side in the up-down direction of the vehicle in which the internal combustion engine is mounted is formed such that the first side thereof is positioned on the downward side in the up-down direction of the vehicle in which the internal combustion engine is mounted with respect to the second side thereof in the cylinder column direction, and the communicating path is connected to an end section on the first side of the bottom wall.

5. The intake manifold according to claim 3, wherein in the intake introduction section, a straight-line distance from the projection to the intake valve is set longer than a straight-line distance from the connection region of the intake introduction section and the chamber section to the projection.

* * * * *